United States Patent [19]

Holcombe et al.

[11] 4,215,668

[45] Aug. 5, 1980

[54] STOVE

[76] Inventors: Brooks H. Holcombe, 414 Catawba St., Union, S.C. 29379; Homer E. Elwood, 27 S. Forth, Lockhart, S.C. 29364

[21] Appl. No.: 815,800

[22] Filed: Jul. 15, 1977

[51] Int. Cl.[3] ..... F24B 1/02

[52] U.S. Cl. ..... 126/60; 126/64; 126/77; 126/83; 126/193

[58] Field of Search ..... 110/175 R; 126/193, 126/202, 60–66, 304 A, 305, 77, 83; 248/349

[56] References Cited

U.S. PATENT DOCUMENTS

| | | | |
|---|---|---|---|
| 188,475 | 3/1877 | Martin | 126/65 X |
| 787,310 | 4/1905 | Schweizer | 126/58 |
| 806,160 | 12/1905 | Metz | 126/202 X |
| 2,125,517 | 8/1938 | Nicol | 110/175 R X |
| 2,296,447 | 9/1942 | Lowe | 126/73 |
| 3,486,629 | 12/1969 | Slaga | 248/349 X |
| 3,986,488 | 10/1976 | Hannebaum | 126/60 X |
| 3,993,040 | 11/1976 | Antone | 126/60 |
| 4,027,649 | 6/1977 | Jackson | 126/202 X |

FOREIGN PATENT DOCUMENTS

| | | | |
|---|---|---|---|
| 128863 | 7/1950 | Sweden | 126/65 |

*Primary Examiner*—Albert J. Makay
*Assistant Examiner*—William E. Tapolcai, Jr.
*Attorney, Agent, or Firm*—Luke J. Wilburn, Jr.; Wellington M. Manning, Jr.

[57] ABSTRACT

A free standing stove having excellent thermal emission and fuel combustion characteristics comprising front, back, base, top and side plates of high strength, heat transmitting metal defining a main body of the stove. The interior of the main body of the stove is provided with a horizontal baffle plate disposed between top and base plates to divide the stove into a lower fuel-receiving and heating compartment and an upper heating compartment. The two compartments communicate by a passageway adjacent a side plate of the stove, and the side plate is provided with an access opening and door to permit insertion of fuel into the lower fuel-receiving compartment. The access door is provided with upper and lower dampers which may be adjusted to circulate air across the stove to retard the movement of combustion gases and by-products through the passageway communicating the upper and lower compartments, and to provide oxygen for combustion of the fuel in the upper and lower compartments, respectively. Flange means surround the top and side portions of the side access door opening and extend inwardly from the side plate to further facilitate direction of the air across the lower compartment and prevent escape of combustion gases and by-products from the access door when the door is opened to refuel the stove. The base plate of the stove is disposed in an upwardly extending plane from back to front of the stove to facilitate forward radiation of heat from the base plate of the stove into the room to be heated.

9 Claims, 3 Drawing Figures

STOVE

The present invention relates to a stove construction and, more particularly, to a wood or coal burning, free-standing stove of unique design which provides excellent heat transmission and fuel combustion in use.

The construction of the stove of the present invention may be best described and understood from the following detailed description of a preferred embodiment of the stove, when taken together with the accompanying drawings, in which.

Figure 1:
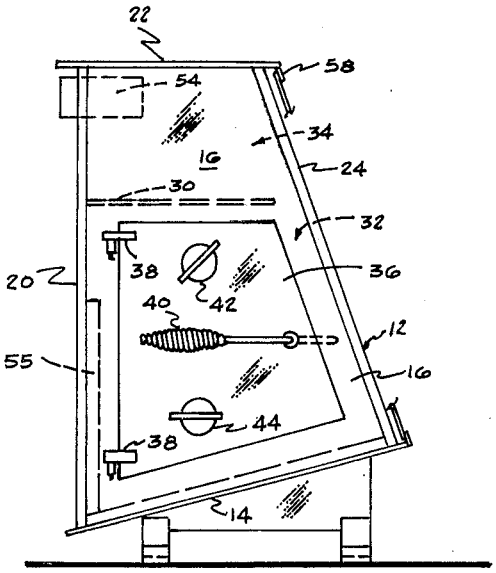
FIG. 1 is a left side elevation view of a stove construction of the present invention.
Figure 2:
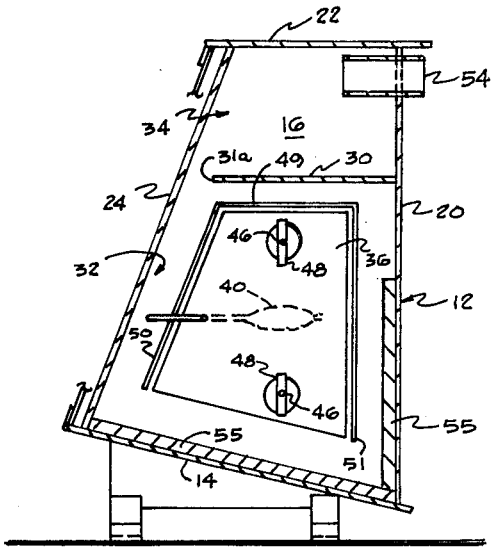
FIG. 2 is a sectional elevational view of the stove, taken generally along line II—II of FIG. 3, and looking in the direction of the arrows; and, FIG. 3 is a front elevational view of the stove of the present invention, with certain interior components thereof shown in broken line.
Figure 3:
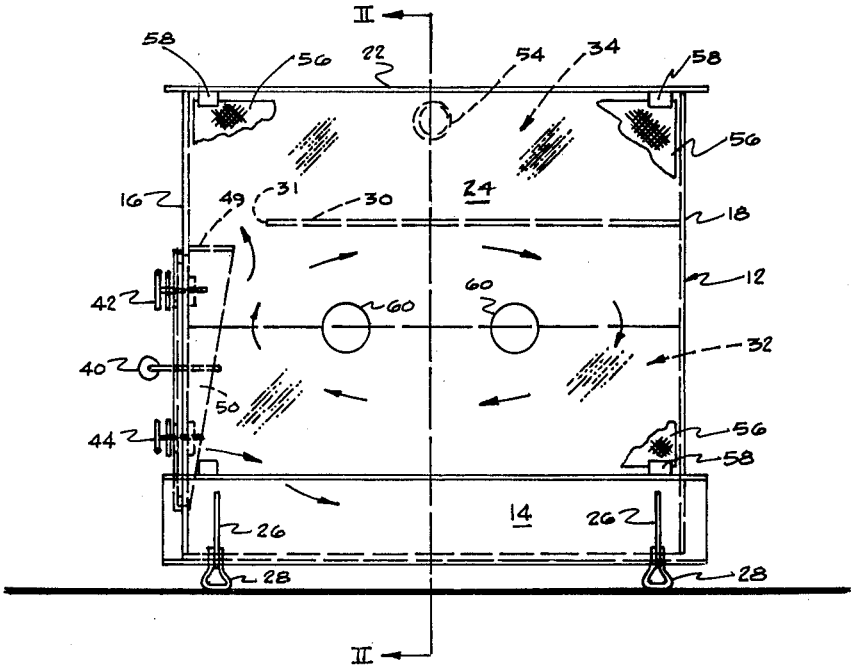

Referring more specifically to the drawings, the embodiment of the stove shown in FIGS. 1-3 comprises a main body 12 which includes a base plate 14, vertical side plates 16, 18 and back plate 20, horizontal top plate 22, and a front plate 24 which extends upwardly and rearwardly from the base plate toward the back of the stove (FIGS. 1 & 2). The plate of the stove are composed of high-strength material having excellent heat conductivity, such as steel, and are attached to each other in suitable manner, preferably by welding.

The main body 12 of the stove is supported on a pair of vertically disposed, triangular plates 26 having depending feet 28. Plates 26 are attached to base plate 14, as by welding, and position the base plate in a plane extending upwardly from back to front of the stove, as best shown in FIGS. 1 and 2.

Horizontally disposed within the stove, in spaced relation below top plate 22, is a primary baffle plate 30 which divides te interior of the stove into a lower fuel-receiving and heating compartment 32, and an upper heating compartment 34 for containing heated gases and combustion products passing from the lower fuel compartment. As seen in FIGS. 1-3, baffle plate 30 is attached to an extends along the interior surface of the back and right side plates. The left edge 31 of the baffle plate 30, as seen in FIG. 3, is spaced from the left vertical side plate 16 to provide an elongate opening for passage of gases and combustion products from fuel compartment 32 into upper heating compartment 34, as will be explained.

In a preferred embodiment, the front edge 31*a* of the baffle plate 30 also is spaced a short distance from the inclined front plate 24 (FIGS. 1 and 2) to provide a narrow, elongate opening along the front plate 24 whereby during periods when the fuel compartment contains relatively large amounts of fuel, flames from the fuel compartment 32 may pass upwardly along the front wall and into the upper heating compartment 34 to facilitate complete combustion of gases therein. Preferably, the front plate slopes rearwardly at an angle of approximately 25 degrees to 30 degrees from the vertical.

As best seen in FIG. 1, the left side plate 16 of the stove is provided with an access door 36 and opening for introduction of fuel into the fuel compartment 32 of the stove. Access door 36 is pivotally mounted on the side plate by hinges 38 and has a pivotable locking handle 40 and upper and lower dampers with cover plates

42 and 44. Each of the cover plates 42, 44 may be rotatably adjusted by means of a central bolt 46 threadably received in a cross bar 48 in each damper opening (FIG. 2) to regulate passage of air into the stove. The inside peripheral edge portion of access door 36 has a channel which mates with a raised surface (not shown) on the side plate around the access opening to effectively seal the edge portions of the door against the stove when the door is closed.

As best seen in FIGS. 2 and 3, the inner wall of side plate 16 is provided with inwardly extending flange elements 49, 50, 51, adjacent the upper and side edges of the access opening which serve as baffles to prevent escape of smoke from the access opening when door 36 is opened to supply fuel to the stove. As seen in FIG. 3, the upper horizontal flange element 49 resides in a plane slightly below the horizontal plane of the primary baffle plate 30 and serves, with plate 30, to control the flow of circulating air entering the stove during combustion, as will be explained. As seen in FIG. 3, flange elements 50, 51 are triangular in shape and taper from top to bottom of the access opening.

Located in the upper central portion of back plate 20 is a horizontal flue pipe 54 which extends into the upper compartment 34 and communicates the compartment with a conventional exterior pipe (not shown) for removal of products of combustion from the stove. The interior surface of base plate 14 and the lower portion of back plate 20 in fuel compartment 32 are lined with suitable insulation material, such as fire brick 55, to support the main body of the fire and fuel during use of the stove.

As a safety feature, the front plate 24 of the stove may be provided with a screen 56, portions of which are shown in FIG. 1, which is spaced by brackets 58 from the front plate to prevent accidental contact of the plate when the stove is in use. One or more glass-covered observation ports 60 may be employed in the front plate, if desired.

In operation, fuel, such as wood or coal, is inserted into the lower fuel compartment and the lower damper 44 of access door 36 is adjusted to provide sufficient air for combustion of the fuel. Due to the rearwardly sloping arrangement of base plate 14, preferably at an angle of no more than about 15 degrees with the horizontal, burning fuel concentrates in the back, bottom portion of the stove during burning. During use, heated gases of combustion pass upwardly from the fuel compartment into upper heating compartment 34 of the stove through the passageway formed between the edges of the primary baffle plate 30 and horizontal flange element 49. The upper damper 42 of the door is adjusted to introduce air into the upper portion of the fuel compartment. Due to the combined effect of primary baffle 30 and horizontal flange 49, most of the air entering upper damper 42 passes generally horizontally across the length of the stove in the upper portion of the fuel compartment, as illustrated by the arrows in FIG. 3, to provide a somewhat clockwise "rolling action" of gases in the fuel compartment during combustion.

The horizontal movement of the air through the upper damper opening also serves to retard to flow of combustion gases passing through the passageway between the upper and lower compartments 32, 34, thus entraining a portion of the combustion materials carried thereby in the lower fuel compartment for more complete burning thereof.

The heated gases passing into upper heating compartment 34 of the stove are retained for a period therein due to the generally horizontal path therethrough to the entrance of horizontal flue pipe 54. Heated gases in the upper compartment are thus retained to provide additional heat for heating the room, and, due to the high temperatures in the upper heating compartment, to permit further combustion of the partially combusted particles in the gases.

Due to the forward, upwardly slope of base plate 14, improved forward radiation of heat from the base plate across the lower floor area of the room may be achieved.

From the foregoing description, it can be seen that the unique arrangement of elements of the stove shown in FIGS. 1–3 cooperate to provide excellent heat transmission and fuel combustion during use of the stove. The particular location of the dampers, primary baffle, and flange elements produce excellent circulation of air and heated gases throughout the interior of the stove to provide optimum utilization of fuel and effective transmission of heat into the room area.

That which is claimed is:

1. A free standing stove having excellent thermal emission and fuel combustion characteristics comprising front, back, base, top, and side plates of high-strength, heat-transmitting metal defining a main body of said stove, support means attached to said main body to position said main body in spaced relation from a supporting floor, an access opening and closure door in one side plate of said main body for introducing fuel into said main body, a horizontal baffle plate positioned in the interior of said main body between said top and base plates and defining with said plates of said main body a lower, fuel-receiving and heating compartment and an upper heating compartment, said baffle plate attached to the back plate and opposite side plate from said one side plate of said main body and having a side edge positioned in spaced relation from said one side plate to define a passageway therebetween communicating said upper and lower compartments to permit passage of combustion gases and by-products from said lower fuel-receiving compartment into said upper heating compartment, outlet means in one of said main body plates communicating with said upper compartment for removal of combustion gases and by-products of combustion from said main body, lower damper means in said access door communicating with said lower compartment for introducing air into a lower portion of said lower compartment to provide oxygen for combustion of fuel in said lower compartment, flange means attached to and extending inwardly of said one side plate adjacent the top edge of said access opening, and upper damper means in said access door communicating with the upper portion of said lower compartment below said horizontal baffle plate and access opening flange means to provide air for circulation generally across said compartment to retard movement of combustion gases and by-products through said passageway from said lower compartment to said upper compartment.

2. A stove as defined in claim 1 wherein said flange means is attached to and extends inwardly of said one side plate about the top and side edges of said access opening, the upper extent of said flange means being positioned in a lower plane from the plane of said horizontal baffle plate to facilitate direction of air from said upper damper means in said access door across the lower compartment of said main body, said flange means further serving to retard escape of combustion gases and by-products from said access opening when said access door is open.

3. A stove as defined in claim 2 wherein portions of said flange means extending inwardly of said one side plate about side edges of said access opening taper downwardly toward said one side plate.

4. A stove as defined in claim 1 wherein said support means are attached to said base plate to position said base plate in a plane extending upwardly from back to front plate of said main body to provide forward radiation of heat from said base plate and to facilitate concentration of fuel in the back portion of said lower compartment during combustion of the fuel.

5. A stove as defined in claim 5 wherein said base plate extends upwardly at an angle of no more than about 15 degrees with the horizontal.

6. A stove as defined in claim 1 wherein each of said damper means includes an opening through said access door for the passage of air into lower compartment, and adjustable closure means for said opening to regulate flow of air into said lower compartment therethrough.

7. A stove as defined in claim 1 including a layer of heat resistant material lining the inside surface of said base plate and the lower inside surface portion of said back plate to support fuel inserted into said lower compartment of said stove.

8. A stove as defined in claim 1 wherein said outlet means in one of said main body plates communicating with said upper compartment comprises a horizontal pipe attached to and extending inwardly through the upper central portion of said back plate and into said upper compartment of said main body.

9. A stove as defined in claim 1 including one or more observation ports in said front plate, and screen means attached to said front plate in outward spaced relation therefrom to prevent accidental contact of said front plate when the stove is in use.

* * * * *

UNITED STATES PATENT AND TRADEMARK OFFICE

CERTIFICATE OF CORRECTION

PATENT NO. : 4,215,668

DATED : August 5, 1980

INVENTOR(S) : Brooks H. Holcombe, Homer E. Elwood

It is certified that error appears in the above-identified patent and that said Letters Patent are hereby corrected as shown below:

Column 1, line 20, "line" should read--lines--.

Column 1, line 27, "plate" should read--plates--.

Claim 5, column 4, line 30, "5" should read--4--.

Claim 6, column 4, line 35, after "into" insert--said--.

Signed and Sealed this

*Eleventh* Day of *November 1980*

[SEAL]

*Attest:*

SIDNEY A. DIAMOND

*Attesting Officer*

*Commissioner of Patents and Trademarks*